US006374502B1

(12) United States Patent
Holcomb et al.

(10) Patent No.: US 6,374,502 B1
(45) Date of Patent: Apr. 23, 2002

(54) HAND-HELD CAN OPENER

(75) Inventors: David A. Holcomb; Joshua R. Stewart, both of Seattle, WA (US)

(73) Assignee: Chef'n Corporaton, Seattle, WA (US)

( * ) Notice: Subject to any disclaimer, the term of this patent is extended or adjusted under 35 U.S.C. 154(b) by 0 days.

(21) Appl. No.: 09/687,212

(22) Filed: Oct. 12, 2000

(51) Int. Cl.[7] ..... B67B 7/46; B67B 7/72
(52) U.S. Cl. ..... 30/417; 418/426
(58) Field of Search ..... 30/416, 419, 420, 30/422, 426, 427

(56) References Cited

U.S. PATENT DOCUMENTS

| | | | | | |
|---|---|---|---|---|---|
| 44,856 | A | | 11/1864 | Dick | |
| 191,416 | A | | 5/1877 | Fetter | |
| 280,495 | A | | 7/1883 | McWilliams | |
| 1,364,016 | A | | 12/1920 | Worthington | |
| 2,718,056 | A | | 9/1955 | Burnett | 30/15.5 |
| 2,924,878 | A | | 2/1960 | Brown | 30/15.5 |
| 4,186,485 | A | | 2/1980 | Bainton et al. | 30/410 |
| 4,563,818 | A | * | 1/1986 | Kreth et al. | 30/417 |
| D282,521 | S | | 2/1986 | Steinko | D8/39 |
| 4,754,550 | A | * | 7/1988 | Koo | 30/417 |
| 4,825,554 | A | * | 5/1989 | Koo | 30/417 |
| D304,900 | S | | 12/1989 | Miquelot | D8/39 |
| 5,022,159 | A | | 6/1991 | Cressman et al. | 30/418 |
| D322,919 | S | | 1/1992 | Holcomb et al. | D8/39 |
| 5,291,658 | A | * | 3/1994 | Wilson et al. | 30/418 |
| 5,581,897 | A | * | 12/1996 | Liebscher | 30/416 |

FOREIGN PATENT DOCUMENTS

| | | |
|---|---|---|
| GB | 2 161 449 A | 1/1986 |
| TW | 7328346 | 3/1985 |
| TW | 7420634 | 4/1986 |

* cited by examiner

*Primary Examiner*—Hwei-Siu Payer
(74) *Attorney, Agent, or Firm*—Seed Intellectual Property Law Group PLLC

(57) ABSTRACT

A hand-held can opener having a grip handle, a grip block pivotally mounted to the forward end of the grip handle, a scissors handle pivotally mounted to the grip block, and having a unique improved one way clutching assembly. The clutching assembly employs a pinion gear having slanted notches. A toothed ring has circumferentially spaced slanted teeth that mesh in the slanted notches. During driving rotation of the toothed ring, right angle surfaces of the slanted notches on the pinion gear and right angle surfaces on the teeth of the toothed ring mesh so that the toothed ring is rotated. This rotation is carried into rotation of a cup through mating non-circular square periphery on the toothed ring fitted in a square recess in the cup. The cup is then connected to an axle to rotatably drive the axle and thus drive the can rim drive wheel. A latch has a stop to maintain the cutter spaced from the can rim drive wheel until rotary motion of the drive wheel is halted.

8 Claims, 4 Drawing Sheets

HAND-HELD CAN OPENER

TECHNICAL FIELD

This invention pertains to hand-held can openers of the type having a squeeze-type action to latch onto and pierce the can with a cutter and subsequently rotate the can past the cutter.

BACKGROUND OF THE INVENTION

The invention particularly is directed to an improved one way clutching assembly for converting the reciprocal motion of the handles of a hand-heldopener into unidirectional rotation of a can rim drive or feed wheel. The invention also relates to improvements in attaching the opener to the can.

Hand-held can openers of this type have been disclosed for squeezing handles together for rotating a drive wheel to advance the can past the cutter. U.S. Pat. No. 5,022,159 is an example of such a can opener. This U.S. Pat. No. 5,022,159 is owned by the assignee of this invention.

One of the difficulties with hand-held can openers is to provide a can rim drive wheel clutching assembly that drives the wheel unidirectionally, but does not skip or fail to operate with minor wear. Another difficulty comes from reliably attaching the opener to the can and piercing the can lid.

SUMMARY OF THE INVENTION

This invention is directed to a hand-held can opener in which an improved one way clutching assembly is provided for rotating the can rim drive wheel in one direction only. The clutching assembly provides positive driving action in the desired direction, but allows ease of slippage in the opposite direction. This one way clutching assembly in the combination provides for an improved driving arrangement with long lasting use and minimum skipping of the rotation during the oscillations of the handle.

This invention is also directed to an improved arrangement for more reliably attaching the opener to the can and piercing the can with the cutter.

DETAILED DESCRIPTION OF THE INVENTION

Figure 1:
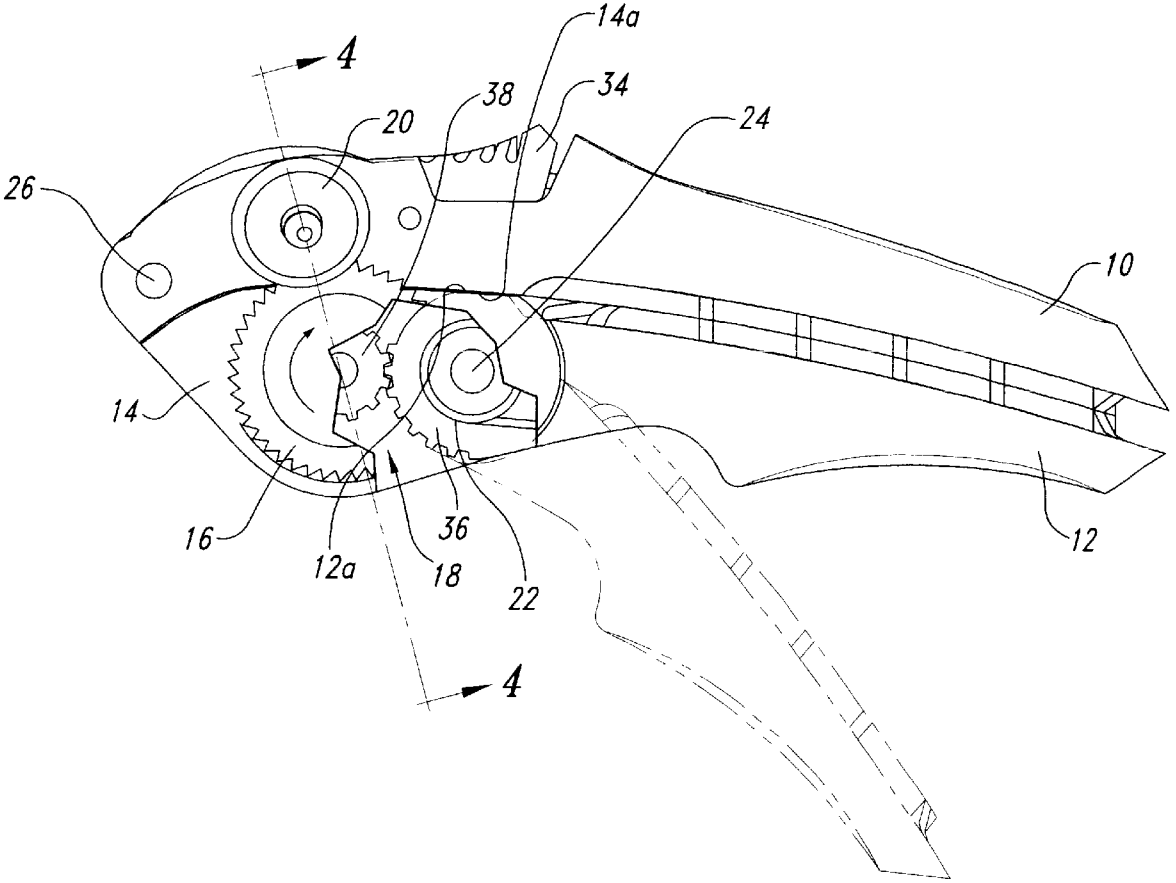
FIG. 1 is a side elevation with parts broken away for clarity of the can opener embodying the principles of the invention.
Figure 2:
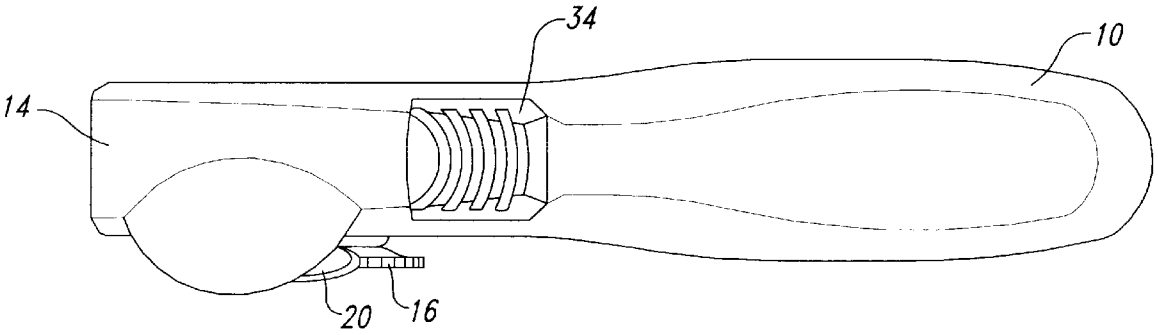
FIG. 2 is a plan view of the invention.
Figure 3:
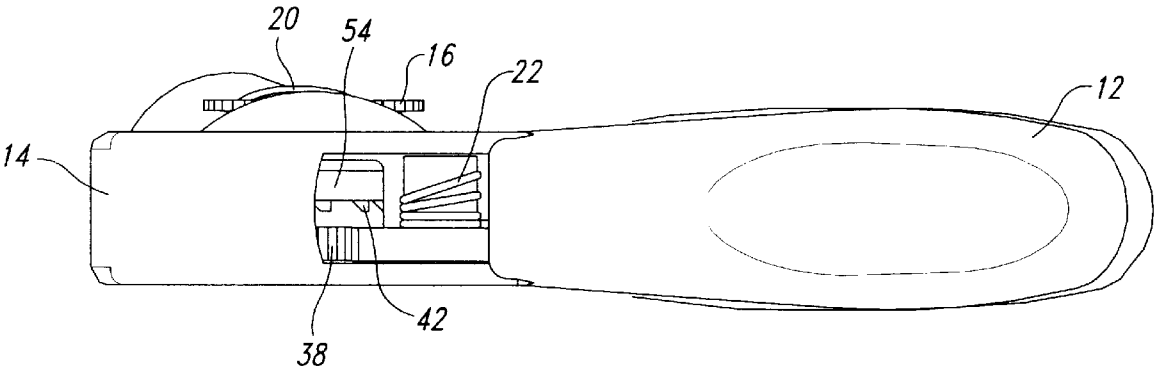
FIG. 3 is a bottom view of the invention.

As best shown in FIG. 1, the hand-held can opener has a grip handle 10, a scissors or moveable handle 12, a grip block 14, a can rim feed wheel 16 that is driven by a unidirectional or one way clutching assembly 18. As is well understood, the unidirectional can rim drive wheel 16 rotates the can past a conventional rotary cutter 20. The cutter 20 penetrates the lid and cuts the circular lid adjacent the rim of the can, as is well known. As is also illustrated in prior U.S. Pat. No. 5,022,159, a handle return spring 22 pushes the scissors handle away from the grip handle 10 to actuate the one way clutching mechanism 18 by oscillating the movable handle 12. As described in the prior patent, the moveable handle 12 pivots about a pin 24 on the grip block 14. The grip block 14 pivots about a pin 26 on the grip handle 10. A latch mechanism best shown in FIG. 5 includes a flexible tang 28 connected to the grip block 14 and having a latching head 30 that hooks over a lip 32. A stop 33 is also provided. When the head 30 is in the position shown in solid lines in FIG. 5, the grip block 14 is held against the grip handle 10 holding the cutter 20 in overlapping cutting relationship with the can rim drive wheel 16 to thus pierce lid of the can. The head 30 can be released from the lip 32 by sliding a button 34 rearwardly to engage the head 30 and move it rearwardly out of engagement with the lip 32. With the head 30 disengaged from the lip 32, the grip block 14 along with the scissors handle 12 is swung away from the grip handle 10 opening a gap between the cutter 20 and the can rim drive wheel 16 to remove the can. The latching mechanism of the prior U.S. Pat. No. 5,022,159 can also be used as an alternative.

As in the prior patent, oscillation of the scissors handle 12 moves gears to create unidirectional rotational output of the can rim drive wheel 16. The earlier patent used a unique overrunning roller clutch made by the Torrington Company. While this clutch worked, the clutching assembly of the instant invention is an improvement over that overrunning clutch mechanism of the prior patent.

Figure 4:
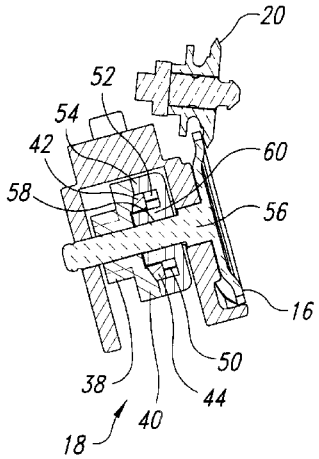
FIG. 4 is a fragmentary section taken along the line 4—4 of FIG. 1.
Figure 6:
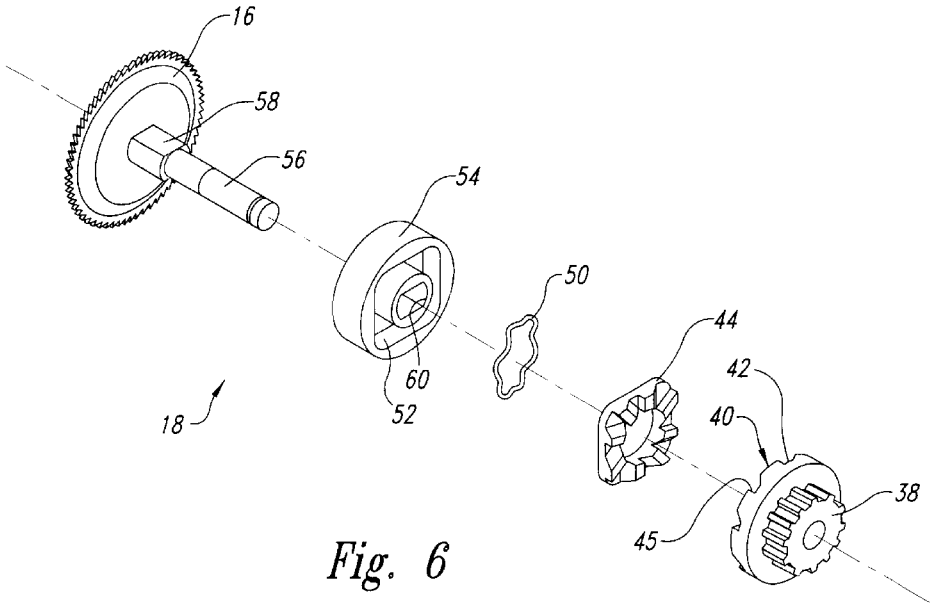
FIG. 6 is an isometric exploded view showing more details of the one way clutching assembly of the invention.
Figure 7A:
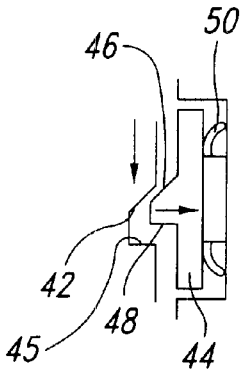
FIG. 7A and FIG. 7B are schematic illustrations of the operation of the clutching mechanism.

As best shown in FIGS. 1, 4, and 6, the improved one way clutching assembly 18 includes a curved gear rack 36 fixed to the scissors handle 12 for oscillation therewith. The gear rack 36 meshes with a pinion or driven gear 38 having an enlarged laterally offset face 40 [FIG. 4] provided with circumferentially spaced slanted notches 42 and straight walls 45 (FIG. 7A). Meshed within these notches 42 is a toothed ring 44 having circumferentially spaced axially protruding teeth each also with a slanted surface 46 and a straight surface 48. The teeth on the ring 44 protrude axially to mesh inside the face 40 of the pinion gear 38. A disc spring 50 biases the toothed ring 44 axially toward the slanted notches in the face 40 of the pinion gear 38. The perimeter of the toothed ring 44 is non-circular, a square in the preferred embodiment, and fits within a mating non-circular recess 52 of a cup 54. The can rim drive wheel 16 is drivingly connected to an axle 56 which has a non-circular stem segment 58 that fits within the non-circular mating axle hub 60 on the cup 54. Thus, if the cup 54 is rotated, it in turn rotates the can rim drive wheel 16.

Figure 7B:
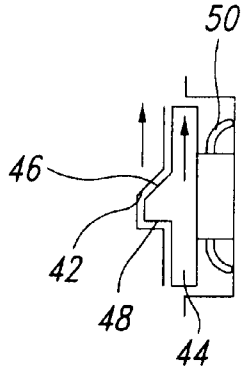

In operation, the scissors handle 12 is closed toward the grip handle 10. This closes the latching mechanism to hold the can rim drive wheel 16 overlapping the cutter 20 in a can lid cutting position. Then the return spring 22 allows the scissors handle 12 to pivot downwardly relative to the grip block 14. When the scissors handle 12 is squeezed to move it back toward the grip handle 10, the curved gear 38 rack 36 rotates the pinion 38 which thus rotates the notches 42 in the face 40 to drive the ring 44. This driving motion is then transmitted to driving motion of the cup 54 and thus to the can rim drive feed wheel 16 to rotate the rim of the can past the rotary cutter 22 to cut the lid of the can. The spring return action of the scissors handle 12, however, causes the slanted surfaces 46 of the toothed ring 44 to ride up on the slanted notches 42 of the pinion gear 38 [FIG. 7A] and allows relative movement between the toothed ring 44 and the pinion gear 38. This sliding motion drives the toothed ring 44 axially to the right as shown in FIG. 7A to allow the toothed ring 44 to slide over the pinion gear 38 surfaces so that no motion is transmitted from the toothed ring 44 to the cup 54. The can rim drive wheel 16 remains stationary as the scissors handle 12 is returned away from the grip handle 10 by the spring 22. When the motion is reversed and the scissors handle 12 is moved toward the grip handle 10, the right angle surfaces 45 of the pinion gear 38 and the right angle surfaces 48 on the toothed ring 44 [FIG. 7B] again become engaged to drive the can rim drive wheel 16.

Figure 5:
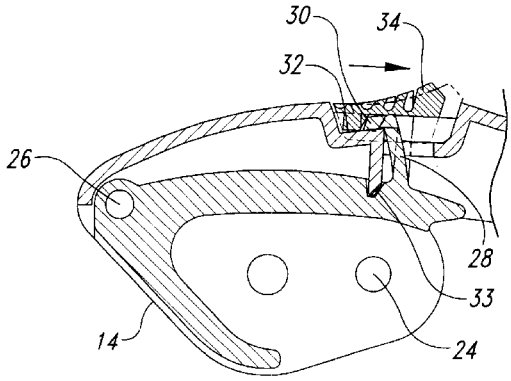
FIG. 5 is a partial fragmentary vertical section showing a latching mechanism employed in the invention in a position after penetrating the can lid.
Figure 8:
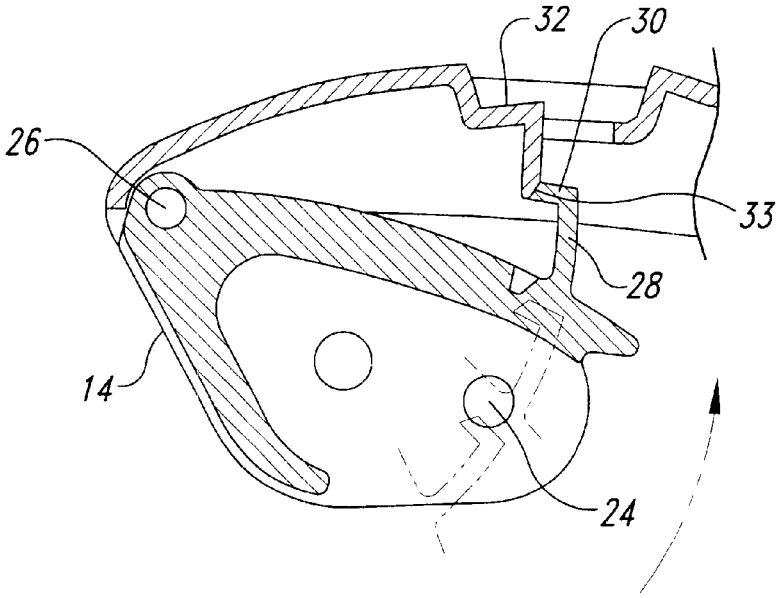
FIG. 8 is a partial fragmentary vertical section also showing the latching mechanism in a position prior to penetrating the can lid.

FIGS. 5 and 8 show the grip block 14 in two different positions. In FIG. 5, the grip block has been pivoted by the scissors handle 12 up against the grip handle 10 until the latching mechanism is engaged and the head 30 is overlying the lip 32. This will cause the cutter 20 to penetrate the can lid. FIG. 8 shows positions of the grip block as it approaches the grip handle 10. The grip block first is pivoted upwardly about the pin 26 as shown in phantom lines in FIG. 8 until the head 30 of the tang 28 engages the stop 33. Then the scissors handle 12 will pivot only about the pin 24 until the top 12*a* of the scissors handle 12 engages the underside 14*a* of the grip block 14. This will cause rotation of the can rim drive wheel 16 as earlier described. However, the cutter 20 will still not have penetrated the lid of the can. Once the top 12*a* of the scissors handle 12 engages the underside of the grip block further closing of the handles will cause the grip block and scissors handle 12 to move together about pivot pin 26 into the solid line position of FIG. 1 by deflecting the head 30 of the flexible tang past the stop 33. The rotation of the can rim drive wheel 16 has ended. This further movement of the grip block beyond the stop 33 into the latching position will move the cutter into the lid of the can while the can rim drive wheel 16 remains stationary. By keeping the can rim drive wheel 16 stationary as the cutter 20 is pushed into the can lid, there is less of a tendency for the can rim to be pushed off of the can rim drive wheel 16.

While the preferred embodiments of the invention have been illustrated and described, it should be apparent to one skilled in the art that variations can be made without departing from the principles therein. Accordingly, the invention is not to be limited to the specific embodiments illustrated in the drawings.

From the foregoing it will be appreciated that, although specific embodiments of the invention have been described herein for purposes of illustration, various modifications may be made without deviating from the spirit and scope of the invention. Accordingly, the invention is not limited except as by the appended claims.

We claim:

1. A hand-held can opener, comprising:

a movable handle;

a grip block, said movable handle being pivotally mounted on said grip block, said grip block having a can rim drive wheel and a latch;

a clutching assembly having a one-way output and being mounted on said grip block and drivingly engaged with said can rim drive wheel;

a gear rack on the movable handle in meshing engagement with said clutching assembly for rotating said can rim drive wheel through the clutching assembly in one direction only;

a grip handle pivotally secured to the grip block and having a freely rotatable cutter and a keeper releasable lockingly engageable for locking the drive wheel adjacent to the cutter; and a return spring for separating the movable handle and the grip handle for allowing oscillation of the pivotal movement of the movable handle by a repetitive squeezing motion.

2. The opener of claim 1, wherein the clutching assembly includes a driven gear having teeth about its periphery, the driven gear having an axially inward face having circumferentially spaced slanted notches, a driven ring having circumferentially spaced teeth engageable with the notches to rotate the ring; the ring having a non-circular outer periphery, a cup having a non-circular recess axially aligned with the non-circular outer periphery of said ring and slideably engaged thereon, the cup being drivingly engaged with an axle, the axle drivingly engaged with the can rim drive wheel, and a spring between the cup and the ring for resiliently urging the ring axially outwardly toward the spaced notches of the driven gear so that rotation of the driven gear in one direction drivingly engages the ring and thus the cup and the axle but rotation of the driven gear in the opposite direction allows the slanted notches to slide over the spaced teeth of the ring pushing the ring out of driving engagement with the driven gear.

3. The opener of claim 2, wherein said grip block having a protruding tang, said grip handle having a latch notch, said tang having a holding position in the latch notch for locking the grip block to the grip handle and a release position for freeing the grip block from the grip handle to open the grip block to create a gap between the cutter and the can rim drive wheel for inserting a can rim there between and a locked position with the grip block adjacent to the grip handle to close the gap so that the can rim drive wheel overlaps the cutter to penetrate the lid of a can.

4. The opener of claim 3, said latch having a stop for holding the cutter and can rim drive wheel away from one another until the unidirectional rotation of the can rim drive wheel has halted so that the cutter penetrates the lid of the can while the can rim drive wheel is stationary.

5. The opener of claim 1, said grip block having a protruding tang, said grip handle having a latch notch, said tang having a holding position in the latch notch for locking the grip block to the grip handle and a release position for freeing the grip block from the grip handle to open the grip block to create a gap between the cutter and the can rim drive wheel for inserting a rim of a can there between and a locked position with the grip block adjacent to the grip handle to close the gap so that the can rim drive wheel overlaps the cutter to penetrate the lid of a can.

6. The opener of claim 1, said latch having a stop for holding the cutter and can rim drive wheel away from one another until the unidirectional rotation of the can rim drive wheel has halted so that the cutter penetrates the lid of the can while the can rim drive wheel is stationary.

7. A hand held can opener comprising means for moving a can rim drive wheel into overlapping position with a rotary cutter to penetrate the lid of a can;

drive means having a unidirectional output for rotating the drive wheel in one direction only to move the can lid past the cutter;

a stop for holding the drive wheel away from an overlapping position with the cutter until the drive wheel has ceased its rotation; and a latch for locking the drive wheel and the cutter in the overlapping position so that the cutter penetrates into the lid of the can while the drive wheel is stationary.

8. The opener of claim 7, said drive means includes a driven gear having teeth about its periphery, the driven gear having an axially inward face having circumferentially spaced slanted notches, a driven ring having circumferentially spaced teeth engageable with the notches to rotate the ring; the ring having a non-circular outer periphery, a cup having a non-circular recess axially aligned with the non-circular outer periphery of said ring and slideably engaged thereon, the cup being drivingly engaged with an axle, the axle drivingly engaged with the can rim drive wheel, and a spring between the cup and the ring for resiliently urging the ring axially outwardly toward the spaced notches of the driven gear so that rotation of the driven gear in one direction drivingly engages the ring and thus the cup and the axle but rotation of the driven gear in the opposite direction allows the slanted notches to slide over the spaced teeth of the ring pushing the ring out of driving engagement with the driven gear.

* * * * *